US011088472B2

(12) United States Patent
Kubota et al.

(10) Patent No.: US 11,088,472 B2
(45) Date of Patent: Aug. 10, 2021

(54) TIN-PLATED COPPER TERMINAL MATERIAL, TERMINAL, AND WIRE TERMINAL PART STRUCTURE

(71) Applicant: MITSUBISHI MATERIALS CORPORATION, Tokyo (JP)

(72) Inventors: Kenji Kubota, Naka (JP); Yoshie Tarutani, Naka (JP); Kiyotaka Nakaya, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 478 days.

(21) Appl. No.: 15/774,402

(22) PCT Filed: Nov. 24, 2016

(86) PCT No.: PCT/JP2016/084690
§ 371 (c)(1),
(2) Date: May 8, 2018

(87) PCT Pub. No.: WO2017/090638
PCT Pub. Date: Jun. 1, 2017

(65) Prior Publication Data

US 2020/0259274 A1 Aug. 13, 2020

(30) Foreign Application Priority Data

Nov. 27, 2015 (JP) ..... JP2015-232465
Mar. 29, 2016 (JP) ..... JP2016-066515

(51) Int. Cl.
*H01R 13/03* (2006.01)
*H01R 4/18* (2006.01)
(Continued)

(52) U.S. Cl.
CPC ..... *H01R 4/62* (2013.01); *H01R 4/185* (2013.01); *H01R 13/03* (2013.01); *C25D 3/12* (2013.01); *C25D 3/22* (2013.01); *C25D 3/32* (2013.01)

(58) Field of Classification Search
CPC .. C23F 15/00; C25D 7/00; C25D 5/12; C25D 7/0607; C22C 13/00; H01B 1/026;
(Continued)

(56) References Cited

U.S. PATENT DOCUMENTS 6,613,451 B1 * 9/2003 Asahara ..... C23C 28/021 428/647
2012/0325552 A1 12/2012 Sakura
(Continued)

FOREIGN PATENT DOCUMENTS

CN 104246015 A 12/2014
EP 2799595 A1 * 11/2014 ..... H01R 43/16
(Continued)

OTHER PUBLICATIONS

Office Action dated Feb. 14, 2020, issued for the corresponding Taiwan Patent Application No. 105138880.
(Continued)

*Primary Examiner* — Daniel J. Schleis
*Assistant Examiner* — Kevin CT Li
(74) *Attorney, Agent, or Firm* — Locke Lord LLP; James E. Armstrong, IV; Nicholas J. DiCeglie, Jr.

(57) ABSTRACT

On a base member made of copper or a copper alloy, a zinc-nickel alloy layer including zinc and nickel, and a tin layer made of tin alloy are laminated in this order: the zinc-nickel alloy layer has a thickness of 0.1-5 μm inclusive and has a nickel content of 5-50 mass % inclusive, the tin layer has a zinc concentration of 0.6-15 mass % inclusive, and, under an oxide layer which is the outermost layer, a
(Continued)

metal zinc layer, having a zinc concentration of 5-40 at % inclusive and a thickness of 1-10 nm inclusive in $SiO_2$ conversion, is formed on the tin layer.

6 Claims, 5 Drawing Sheets

(51) Int. Cl.

| | |
|---|---|
| ***H01R 4/62*** | (2006.01) |
| *C25D 3/12* | (2006.01) |
| *C25D 3/22* | (2006.01) |
| *C25D 3/32* | (2006.01) |

(58) Field of Classification Search
CPC . H01B 1/023; H01B 7/00; H01R 4/62; H01R 4/18; H01R 13/03
See application file for complete search history.

(56) References Cited

U.S. PATENT DOCUMENTS

| | | | | |
|---|---|---|---|---|
| 2014/0162505 | A1 | 6/2014 | Ohnuma | |
| 2014/0287262 | A1 | 9/2014 | Kato et al. | |
| 2015/0047879 | A1 | 2/2015 | Shibuya et al. | |
| 2016/0064847 | A1* | 3/2016 | Gaertner | C23C 2/06 439/741 |
| 2016/0160321 | A1 | 6/2016 | Ito et al. | |
| 2019/0161866 | A1* | 5/2019 | Kubota | C25D 7/00 |

FOREIGN PATENT DOCUMENTS

| | | | | |
|---|---|---|---|---|
| JP | 2000-144482 | A | | 5/2000 |
| JP | 2004-134212 | A | | 4/2004 |
| JP | 2008-285729 | A | | 11/2008 |
| JP | 2009-084616 | A | | 4/2009 |
| JP | 2009084616 | A | * | 4/2009 |
| JP | 2011-222243 | A | | 11/2011 |
| JP | 2013-033656 | A | | 2/2013 |
| JP | 2015-133306 | A | | 7/2015 |
| JP | 2016-169439 | A | | 9/2016 |
| TW | 201447053 | A | | 12/2014 |
| TW | 201522669 | A | | 6/2015 |
| WO | 2000/015876 | A1 | | 3/2000 |
| WO | 2013/161551 | A1 | | 10/2013 |
| WO | 2014/177563 | A1 | | 11/2014 |

OTHER PUBLICATIONS

International Search Report dated Feb. 28, 2017, issued for PCT/JP2016/084690.

* cited by examiner

TIN-PLATED COPPER TERMINAL MATERIAL, TERMINAL, AND WIRE TERMINAL PART STRUCTURE

TECHNICAL FIELD

The present invention relates to a tin-plated copper terminal material, a terminal formed from the terminal material, and wire terminal part structure using the terminal; in which the terminal material is made by plating tin or tin alloy on a surface of a base member made of copper or copper alloy, and used for a terminal which is crimped to a terminal end of a wire made of an aluminum wire.

Priority is claimed on Japanese Application No. 2015-232465 filed on Nov. 27, 2015 and No. 2016-66515 filed on Mar. 29, 2016, the content of which is incorporated herein by reference.

BACKGROUND ART

Conventionally, crimping a terminal made of copper or copper alloy to an end of a wire made of copper or copper alloy, and connecting this terminal to a terminal of equipment, so that the wire is connected to the equipment. There is a case in which the wire be made of aluminum or aluminum alloy instead of copper or copper alloy in order to reduce weight of the wire.

For example, Patent Document 1 discloses an aluminum wire made of aluminum alloy, for a wire harness of a vehicle.

When a wire (a conductive wire) is made of aluminum or aluminum alloy and a terminal is made of copper or copper alloy, there may be galvanic corrosion by electric potential difference between different metals by water entering into a crimp part between the terminal and the wire. Along with the corrosion of the wire, electric resistance at the crimp part may be increased or crimping force may be deteriorated.

In order to prevent the corrosion, there are ones described in Patent Document 2 or Patent Document 3, for example.

Patent Document 2 discloses a terminal having a base metal part made of a first metal material; an intermediate layer made of a second metal material having a standard electrode potential smaller than that of the first metal material and formed thinly by plating on at least a part of a surface of the base metal part; and a surface layer made of a third metal material having a standard electrode potential smaller than that of the second metal material and formed thinly by plating on at least a part of a surface of the intermediate layer. It is disclosed that the first metal material is copper or alloy thereof, the second metal material is lead or alloy thereof, tin or alloy thereof, nickel or alloy thereof, zinc or alloy thereof, and the third metal material is aluminum or alloy thereof.

Patent Document 3 discloses terminal structure of a wire harness in a terminal end region of a covered wire in which a caulk part formed at one end of a terminal metal part is caulked along an outer peripheral of a covered part of the covered wire, and at least a terminal exposed region of the caulk part and a whole outer periphery of the vicinity region thereof are fully covered by mold resin.

Material for an electric contact of a connector disclosed in Patent Document 4 has a base member made of metal material, an alloy layer formed on the base member, and a conductive film layer formed on a surface of the alloy layer. Patent Document 4 discloses that the alloy layer essentially includes Sn, and further includes an additive element or two or more additive elements selected from Cu, Zn, Co, Ni and Pd, and the conductive film layer includes a hydroxide oxide of $Sn_3O_2(OH)_2$. Furthermore, it is disclosed that, by the conductive film layer including the hydroxide oxide of $Sn_3O_2(OH)_2$, durability under high temperature environment is improved and contact resistance can be maintained low for a long time period.

Patent Document 5 discloses Sn plated material having an Ni plating ground layer, an Sn—Cu plating intermediate layer, and an Sn plating surface layer in this order on a surface of copper or copper alloy. It is disclosed in Patent Document 5 that: the Ni plating ground layer is made of Ni or Ni alloy; the Sn—Cu plating intermediate layer is made of Sn—Cu based alloy in which an Sn—Cu—Zn alloy layer is formed at least on a side adjacent to the Sn plating surface layer; the Sn plating surface layer is made of Sn alloy including 5 to 1000 ppm by weight of Zn; and a high-Zn concentration layer in which a concentration of Zn is greater than 0.1 mass % and to 10 mass % is further formed on an outermost in the Sn plating material.

CITATION LIST

Patent Document

Patent Document 1: Japanese Unexamined Patent Application, First Publication No. 2004-134212

Patent Document 2: Japanese Unexamined Patent Application, First Publication No. 2013-33656

Patent Document 3: Japanese Unexamined Patent Application, First Publication No. 2011-222243

Patent Document 4: Japanese Unexamined Patent Application, First Publication No. 2015-133306

Patent Document 5: Japanese Unexamined Patent Application, First Publication No. 2008-285729

SUMMARY OF INVENTION

Technical Problem

The structure disclosed in Patent Document 3 can prevent the corrosion though, production cost is increased owing to the addition of resin molding process, and moreover, size of the wire harness cannot be reduced, because sectional area of the terminal is increased by the resin. There was a problem of a large cost for aluminum-based plating of the third metal material disclosed in Patent Document 2 because ionic liquid and the like are used.

Tin-plated copper terminal material made by plating tin on base material made of copper or copper alloy is used in many cases for terminal material. If this tin-plated copper terminal material is crimped to an aluminum wire, galvanic corrosion should be hard to be generated since corrosion potential of tin is near to that of aluminum though, galvanic corrosion can be generated when salt water or the like is in contact with the crimped part.

In this case, even when forming the hydroxide oxide layer of $Sn_3O_2(OH)_2$ as in Patent Document 4, durability is not high, because the hydroxide oxide layer may be quickly chipped when it is exposed in corrosion environment or heating environment. Furthermore, as in Patent Document 5, in the one having the Sn—Zn alloy stacked on the Sn—Cu based alloy layer and a zinc-concentrated layer on an outermost layer, productivity of Sn—Zn alloy plating is low, and anti-corrosion effect on an aluminum wire does not work if copper in the Sn—Cu alloy layer is exposed at a surface layer.

The present invention is achieved in consideration of the above subject and has an object to provide a tin-plated copper terminal material, a terminal formed from the terminal material and wire terminal part structure using the terminal, which can prevent galvanic corrosion even when using a copper or copper alloy base member for the terminal crimped to the terminal end of the wire formed from aluminum wire material.

Solution to Problem

A tin-plated copper terminal material according to the present invention including a base member made of copper or copper alloy, a zinc-nickel alloy layer including zinc and nickel and a tin layer made of tin alloy stacked on the base member in this order: in the terminal material, the zinc-nickel alloy layer has a thickness of 0.1 μm to 5.0 μm inclusive and a nickel content of 5 mass % to 50 mass % inclusive; the tin layer has a zinc concentration of 0.6 mass % to 15 mass % inclusive; and a metal zinc layer is further provided on the tin layer and under an outermost oxide layer.

According to the present tin-plated copper terminal material, since the metal zinc layer is formed under the outermost oxide layer and corrosion potential of the metal zinc is near to that of aluminum, it is possible to reduce galvanic corrosion when it is in contact with aluminum wire. Moreover, since the tin layer includes a prescribed amount of zinc so that the zinc is diffused to a surface portion of the tin layer, the metal-zinc layer is maintained to be highly-concentrated. Even when whole or a part of the tin layer is disappeared by abrasion or the like, the zinc-nickel alloy layer thereunder can prevent the galvanic corrosion.

In this case, the thickness of the zinc-nickel layer is 0.1 μm to 5.0 μm inclusive: if the thickness is less than 0.1 μm, there is no effect to lower the corrosion potential at the surface; and if it is more than 5.0 μm, breakages may be generated while pressing the terminal.

If the nickel content in the zinc-nickel alloy layer is less than 5 mass %, substitution reaction may occur while tin plating for forming the tin layer, and adhesion of the tin plating is considerably deteriorated. If the nickel content in the zinc-nickel alloy layer is more than 50 mass %, there is no effect to lower the corrosion potential at the surface.

If the zinc concentration of the tin layer is less than 0.6 mass %, an effect to prevent the corrosion of the aluminum wire by lowering the corrosion potential is poor; and if it is more than 15 mass %, corrosion resistance of the tin layer is considerably deteriorated, so that the tin layer is corroded when exposed in corrosion environment and contact resistance is deteriorated.

In the tin-plated copper terminal material of the present invention, it is desirable that metal zinc layer have zinc concentration of 5 at % to 40 at % inclusive and a thickness of 1 nm to 10 nm inclusive in $SiO_2$ conversion.

The effect to lower the corrosion potential is poor if the zinc concentration in the metal zinc layer is less than 5 at %; the contact resistance may be deteriorated if it is more than 40 at %. The effect to lower the corrosion potential is poor if the thickness of the metal zinc layer in $SiO_2$ conversion is less than 1 nm; the contact resistance may be deteriorated if it is more than 10 nm.

In the tin-plated copper terminal material of the present invention, it is desirable to further include a ground layer made of nickel or nickel alloy between the base member and the zinc-nickel alloy layer that has a thickness of 0.1 μm to 5.0 μm inclusive and a nickel content of 80 mass % or greater.

The ground layer between the base member and the zinc-nickel alloy layer works to prevent dispersion of copper from the base member made of copper or copper alloy to the zinc-nickel alloy layer or the tin layer. If the thickness thereof is less than 0.1 μm, the effect to prevent the dispersion of copper is poor; if it is more than 5.0 μm, cracks are easy to occur while press working. If the nickel content is less than 80 mass %, the effect to prevent the copper from dispersing to the zinc-nickel alloy layer or the tin layer is poor.

The tin-plated copper terminal material of the present invention has a belt shape and includes a carrier part along a longitudinal direction thereof and a plurality of terminal parts formed to be terminals by press working: the respective terminal parts are connected to the carrier part with spacing each other along a longitudinal direction of the carrier part.

A terminal of the present invention is a terminal made of the above-mentioned tin-plated copper terminal material. In wire terminal part structure of the present invention, this terminal is crimped to a terminal end of a wire made of aluminum or aluminum alloy.

Advantageous Effects of Invention

According to the tin-plated copper terminal material of the present invention, since the metal zinc layer having the corrosion potential which is near to that of aluminum is formed under the outermost oxide layer, the galvanic corrosion when the aluminum wire is in contact can be prevented; and moreover, since zinc is diffused from the zinc-nickel alloy layer under the tin layer to the surface part of the tin layer, the metal zinc layer can be maintained to be highly-concentrated, the corrosion resistance is good for a long time period. Furthermore, even if whole or a part of the tin layer is disappeared by abrasion or the like, the galvanic corrosion can be prevented by the zinc-nickel alloy layer thereunder, and an increase of the electric resistance and deterioration of crimping force to the wire can be prevented.

DESCRIPTION OF EMBODIMENT

Tin-plated copper terminal material, a terminal, and wire terminal part structure of embodiments of the present invention will be explained.

Figure 2:
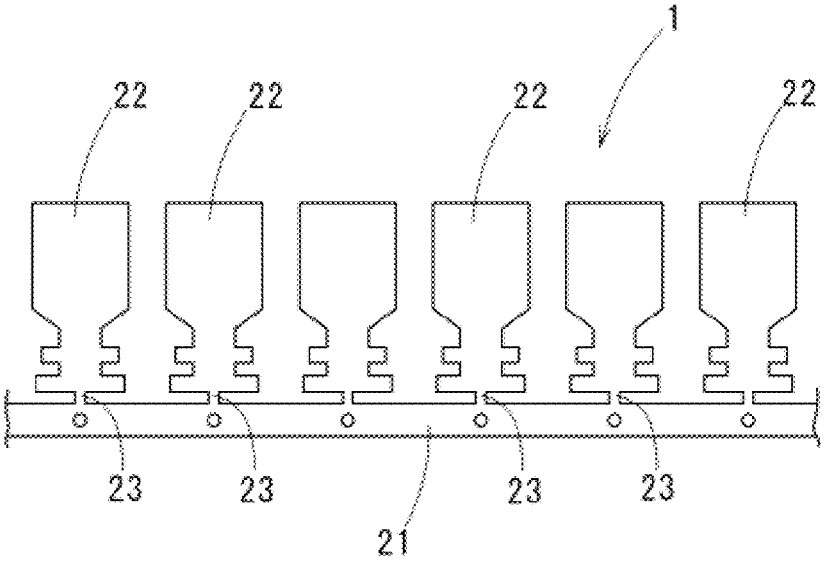
FIG. 2 It is a plan view of a terminal material of the embodiment.

A tin-plated copper terminal material 1 of the present embodiment is, as wholly shown in FIG. 2, a hoop formed having a belt shape in order to form a plurality of terminals: on a carrier part 21 along a longitudinal direction, a plurality of terminal parts 22 to be terminals are disposed with spacing each other along a longitudinal direction of the carrier part 21: the respective terminal parts 22 are connected to the carrier part 21 via narrow connection parts 23. The terminal parts 22 each are formed into a shape of a terminal 10 shown in FIG. 7 for example, and finished as the terminals 10 by being cut from the connection parts 23.

Figure 7:
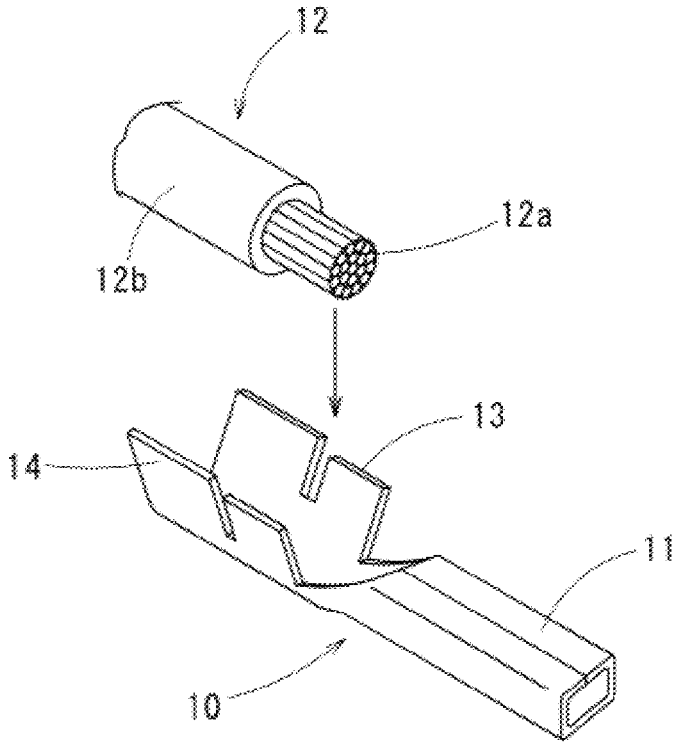
FIG. 7 It is a perspective view showing an example of a terminal in which the terminal material of the embodiment is applied.

In the terminal 10, which is a female terminal in the example of FIG. 7, a connector part 11 into which a male terminal (not illustrated) is fitted, a core-wire crimp part 13 to which exposed core wire 12*a* of a wire 12 are crimped, and a coat crimp part 14 to which a coat part 12*b* of the wire 12 is crimped are integrally formed in this order from a tip thereof.

Figure 8:
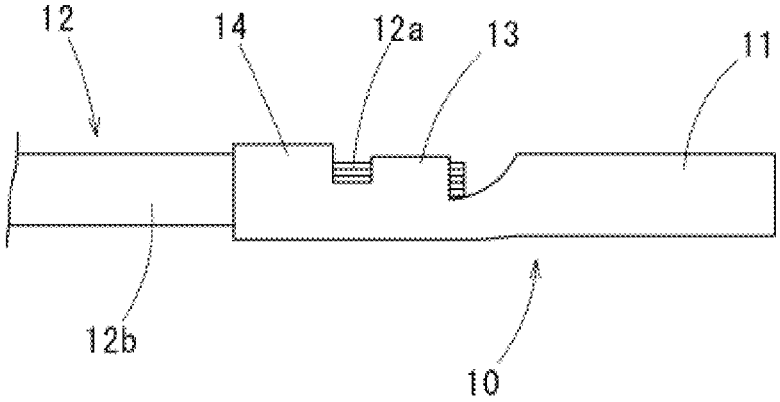
FIG. 8 It is a frontal view showing a terminal end part of a wire to which the terminal of FIG. 7 is crimped.

FIG. 8 shows terminal part structure in which the terminal 10 is crimped to the wire 12. The core-wire crimp part 13 is directly in contact with the core wire 12*a* of the wire 12.

Figure 1:
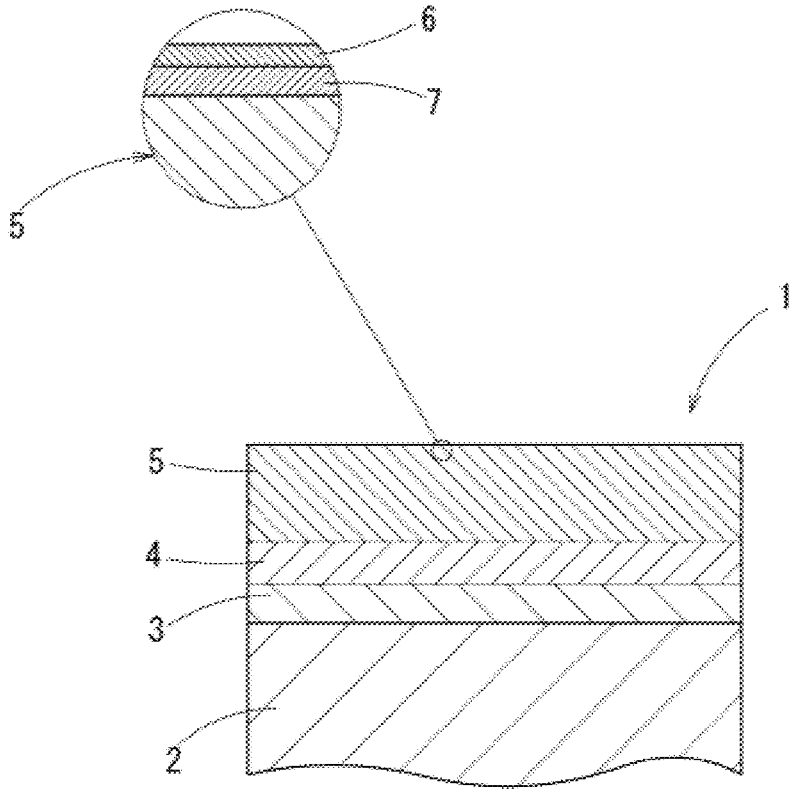
FIG. 1 It is a sectional view schematically showing an embodiment of a tin-plated copper terminal material of the present invention.

In the tin-plated copper terminal material 1, as a section thereof is schematically shown in FIG. 1, a ground layer 3 made of nickel or nickel alloy, a zinc-nickel alloy layer 4, and a tin layer 5 are stacked in this order on a base member 2 made of copper or copper alloy: furthermore, a metal zinc layer 7 is formed under an oxide layer 6 generated at an outermost surface of the tin layer 5 but yet on the tin layer 5.

The base member 2 is made of copper or copper alloy, the composition thereof is not especially limited.

The ground layer 3 has a thickness of 0.1 μm to 5.0 μm inclusive and a nickel content is 80 mass % or greater. The ground layer 3 works to prevent dispersion of copper from the base member 2 to the zinc-nickel alloy layer 4 and the tin layer 5: if the thickness thereof is less than 0.1 μm, an effect to prevent the dispersion of copper is poor, or if it is greater than 5.0 μm, cracks are easy to occur while press working. The thickness of the ground layer 3 is preferably 0.3 μm to 2.0 μm inclusive.

If the nickel content is less than 80 mass %, the effect to prevent the dispersion of copper to the zinc-nickel alloy layer 4 and the tin layer 5 is poor. This nickel content is preferably 90 mass % or greater.

The zinc-nickel alloy layer 4 has a thickness of 0.1 μm to 5.0 μm inclusive and includes zinc and nickel; and also includes tin since it is in contact with the tin layer 5. A nickel content of this zinc-nickel alloy layer 4 is 5 mass % to 50 mass % inclusive.

If the thickness of the zinc-nickel alloy layer 4 is less than 0.1 μm, there is no effect to lower corrosion potential at a surface; if it is greater than 5.0 μm, cracks may occur while press working on the terminal 10. The thickness of the zinc-nickel alloy layer 4 is preferably 0.3 μm to 2.0 μm inclusive.

If the nickel content of the zinc-nickel alloy layer 4 is less than 5 mass %, a substitution reaction occurs while tin plating in order to form the tin layer 5 as mentioned later, and adhesion of the tin plating (the tin layer 5) is considerably deteriorated. If the nickel content in the zinc-nickel alloy layer 4 is greater than 50 mass %, there is no effect to lower the corrosion potential at the surface. The nickel content is preferably 7 mass % to 20 mass % inclusive.

The tin layer 5 has a zinc concentration of 0.6 mass % to 15 mass % inclusive. If the zinc concentration of the tin layer 5 is less than 0.6 mass %, an anti-corrosion effect on the aluminum wire by lowering the corrosion potential is poor; if it is greater than 15 mass %, an anti-corrosion property of the tin layer 5 is considerably deteriorated, and contact resistance is deteriorated because the tin layer 5 corrodes if it is exposed in corrosion environment. The zinc concentration of the tin layer 5 is preferably 1.5 mass % to 6.0 mass % inclusive.

The thickness of the tin layer 5 is preferably 0.1 μm to 10 μm inclusive. If it is too thin, deterioration of solder wettability and contact resistance may occur; if it is too thick, dynamic friction coefficient at a surface may be increased, so that attachment/detachment resistance is tend to be larger when using for a connector or the like.

The metal zinc layer 7 has a zinc concentration 5 at % to 40 at % inclusive and a thickness of 1 nm to 10 nm in $SiO_2$ conversion. If the zinc concentration of this metal zinc layer is less than 5 at %, there is no effect to lower the corrosion potential; if it is greater than 40 at %, contact resistance is deteriorated. The zinc concentration of the metal zinc layer 7 is preferably 10 at % to 25 at % inclusive.

On the other hand, if the thickness of the metal zinc layer 7 is less than 1 nm in $SiO_2$ conversion, there is no effect to lower the corrosion potential; if it is greater than 10 nm, contact resistance is deteriorated. This thickness in $SiO_2$ conversion is preferably 1.25 nm to 3 nm inclusive.

In addition, the oxide layer 6 of zinc and tin is generated at the outermost surface.

Next, a method of manufacturing this tin-plated copper terminal material 1 will be explained.

A sheet material made of copper or copper alloy is prepared as the base member 2. By performing cutting, perforation or the like on this sheet material, a hoop is formed as shown in FIG. 2, in which the plurality of terminal parts 22 are connected to the carrier part 21 via the connection parts 23. After cleaning a surface of this hoop by degreasing, pickling and the like, plating of nickel or nickel alloy for forming the ground layer 3, plating of zinc-nickel alloy for forming the zinc-nickel alloy layer 4, and plating of tin or tin alloy for forming the tin layer 5 are performed in this order.

The plating of nickel or nickel alloy for forming the ground layer 3 is not especially limited if a dense film of nickel as a main constituent can be obtained. The ground layer 3 can be formed by electroplating using a known Watts bath, a sulfamate bath, a citric acid bath or the like. For nickel alloy plating, nickel-tungsten (Ni—W) alloy, nickel-phosphorus (Ni—P) alloy, nickel-cobalt (Ni—Co) alloy, nickel-chrome (Ni—Cr) alloy, nickel-iron (Ni—Fe) alloy, nickel-zinc (Ni—Zn) alloy, nickel-boron (Ni—B) alloy or the like can be used.

Considering deformation property for pressing on the terminal 10 and barrier property to copper, pure nickel plating obtained by the sulfamate bath is desirable.

The zinc-nickel alloy plating for forming the zinc-nickel alloy layer 4 is not limited if a dense film with a desired composition can be obtained; a known sulfate bath, a chloride salt bath, a neutral bath or the like can be used.

The plating of tin or tin alloy for forming the tin layer 5 can be performed by known method. For example, the electroplating can be performed using acidic solution such as an organic acid bath (e.g., a phenol-sulfonic acid bath, an alkane-sulfonic acid bath, or an alkanol-sulfonic acid bath), a fluoroboric acid bath, a halide bath, a sulfate bath, a pyrophosphoric acid bath or the like, or an alkaline bath such as a potassium bath, a natrium bath or the like.

As above, after plating of nickel or nickel alloy, plating of zinc-nickel alloy, and plating of tin or tin alloy on the base member 2 in this order, heat treatment is performed.

In this heat treatment, material is heated at temperature so that surface temperature thereof is 30° C. to 190° C. inclusive. By this heat treatment, zinc in the zinc-nickel alloy layer is diffused in the plated tin layer and on the plated tin layer so as to form the thin metal zinc layer on the surface. Zinc is diffused quickly, so the metal zinc layer 7 can be formed by exposing it at temperature 30° C. or higher for 24 hours or longer. However, zinc-nickel alloy repels molten tin so that tin-repelled parts are generated on the tin layer 5: therefore, it is not performed to heat the temperature rises higher than 190° C.

In the tin-plated copper terminal material 1 manufactured as above, the ground layer 3 made of nickel or nickel alloy, the zinc-nickel alloy layer 4, and the tin layer 5 are stacked in this order on the base member 2 overall; furthermore, the oxide layer 6 is thinly formed at the surface of the tin layer 5, and the metal zinc layer 7 is formed under this oxide layer 6.

Then, the hoop remains as it is but is deformed to have the shape of the terminals 10 shown in FIG. 7 by press working or the like, and the terminals 10 are manufactured by cutting the connection parts 23.

FIG. 8 shows the terminal part structure in which the terminal 10 is crimped to the wire 12, so that the core-wire crimp part 13 is directly in contact with the core wire 12*a* of the wire 12.

In the terminal 10, since the tin layer 5 includes zinc, so the metal zinc layer 7 is formed under the oxide layer 6 at the outermost surface of the tin layer 5; the galvanic corrosion can be prevented even in a state in which it is crimped to the aluminum-made core wire 12*a*, because the corrosion potential of the metal zinc is exceedingly near to that of aluminum. In this case, since the plating and heat treatment were performed in a state of a hoop shown in FIG. 2, the base member 2 is not exposed even at an end surface of the terminal 10. Accordingly, an excellent anti-corrosion effect can be shown.

Moreover, the zinc-nickel alloy layer 4 is formed under the tin layer 5, and zinc thereof is diffused to the surface part of the tin layer 5. Therefore, the metal zinc layer 7 is prevented to be disappeared by abrasion or the like, so that the metal zinc layer 7 can be maintained highly-concentration. Furthermore, even if the whole or a part of the tin layer 5 is disappeared by abrasion or the like, the galvanic corrosion can be prevented since the corrosion potential of the zinc-nickel alloy layer 4 under the tin layer 5 is near to that of aluminum.

The present invention is not limited to the above-described embodiment and various modifications may be made without departing from the scope of the present invention.

For example, although the metal zinc layer at the surface was formed by dispersion from the zinc-nickel alloy layer, the metal zinc layer can also be formed by zinc plating on the surface of the tin layer. This zinc plating can be performed by a known method: for example, electroplating can be performed by using a zincate bath, a sulfate bath, a zinc chloride bath, a cyanogen bath.

EXAMPLES

After degreasing and pickling a copper sheet as the base member, nickel plating for the ground layer, zinc-nickel alloy plating, and tin plating were performed in this order. Conditions of the respective plating were as follows. The nickel content in the zinc-nickel alloy plating was controlled by changing a ratio between nickel sulfate hexahydrate and zinc sulfate heptahydrate. The following plating condition of zinc-nickel alloy is an example in which the nickel content is 15 mass %. Regarding Sample 9, the zinc-nickel alloy plating was not performed: after degreasing and pickling the copper sheet, nickel plating and tin plating were performed in this order. The nickel plating for the ground layer was not performed on Samples 1 to 4. Samples in which the nickel alloy plating was performed for the ground layer were Sample 6 in which nickel-tungsten plating was performed, Sample 8 in which nickel-phosphorus plating was performed, and Sample 10 in which nickel-iron plating was performed.

Nickel Plating Conditions
Composition of Plating Bath
nickel amidosulfate: 300 g/L
nickel chloride: 5 g/L
boric acid: 30 g/L
Bath Temperature: 45° C.
Current Density: 5 A/dm$^2$ Zinc-Nickel Alloy Plating Conditions
Composition of Plating Bath
zinc sulfate heptahydrate: 75 g/L
nickel sulfate hexahydrate: 180 g/L
sodium sulfate: 140 g/L
pH=2.0
Bath Temperature: 45° C.
Current Density: 5 A/dm$^2$ Tin Plating Conditions
Composition of Plating Bath
stannous methanesulfonate:
methanesulfonic acid: 100 g/L
additive
Bath Temperature: 25° C.
Current Density: 5 A/dm$^2$ Next, the copper sheets with the plated layer were made into samples by performing heat treatment at temperature of 30° C. to 190° C. for 1 hour to 36 hours.

Regarding the obtained samples, the thicknesses and the nickel contents of the ground layers and the zinc-nickel alloy layers, the zinc concentrations in the tin layers, and the thicknesses and concentrations of the metal zinc layers were measured respectively.

The thicknesses of the ground layers and the zinc-nickel alloy layers were measured in sections observed by a scanning ion microscope.

The nickel contents were measured as follows: producing observation samples by thinning down the samples to have a thickness of 100 nm or smaller using a focused ion beam device (FIB: SMI3050 TB) made by Seiko Instruments Inc.; observing these observation samples using a scanning transmission electron microscope (STEM: JEM-2010F) made by JEOL Ltd. at acceleration voltage of 200 kV; and measuring the nickel contents using an energy dispersive X-ray spectrometer (EDS) made by Thermo Fisher Scientific annexed to the STEM.

The zinc concentrations in the tin layers were measured at surfaces of the samples using an electron probe micro analyzer (EPMA: JXA-8530F) made by JEOL Ltd. at an acceleration voltage of 6.5 V and a beam diameter 30 μm.

The thicknesses and the zinc concentrations of the metal zinc layers were measured at the respective samples by XPS analysis while etching the surfaces of the samples by argon ion using XPS (X-ray photoelectron spectroscopy) analyzer (ULVAC PHI model—5600LS) made by Ulvac-Phi, Inc. Analyzing conditions were as follows.

X-ray Source: Standard MgKα 350 W

Path Energy: 187.85 eV (Survey), 58.70 eV (Narrow)

Measured Interval: 0.8 eV/step (Survey), 0.125 eV (Narrow)

Photo-electron Take-off Angle with respect to Sample Surface: 45 deg

Analyzing Area: about 800 μm (diameter)

Regarding the thicknesses, "a film thickness in $SiO_2$ conversion" was calculated from a time for measuring using an etching rate of $SiO_2$ measured by a same device in advance.

The etching rate of $SiO_2$ was calculated by etching an $SiO_2$ film having a thickness of 20 nm at a rectangular area of 2.8×3.5 mm by argon ion, and dividing it by the time for etching 20 nm. In the above-mentioned analyzing device it took 8 minutes, so the etching rate is 2.5 nm/min. Depth resolution by XPS is high about 0.5 nm. The time for etching by Ar ion beam is different in accordance with materials. In order to obtain a value of a film thickness itself, flat samples with known film thicknesses should be prepared and the etching rate should be calculated. This method is not easy, so the "film thickness in $SiO_2$ conversion" calculated from the time for etching was utilized, using the etching rate calculated at an $SiO_2$ film having known film thickness. Accordingly, it is necessary to pay attention that the "film thickness in $SiO_2$ conversion" is different from a film thickness of an actual oxide. If the thickness is provided by the etching rate in $SiO_2$ conversion, even if the actual film thickness is not identified, it is possible to evaluate the film thickness quantitatively because relation between the etching rate in $SiO_2$ conversion and the actual film thickness is unequivocal.

Measured results are shown in Table 1.

TABLE 1

| | Ground Layer | | Zn—Ni Alloy Layer | | Tin Layer | Metal Zinc Layer | |
|---|---|---|---|---|---|---|---|
| Sample No. | Thickness (μm) | Ni Content (%) | Thickness (μm) | Ni Content (%) | Zinc Concentraion (%) | $SiO_2$ Thickness (nm) | Concentration (at %) |
| 1 | — | — | 0.1 | 5 | 0.6 | 0.8 | 8 |
| 2 | — | — | 5.0 | 50 | 15 | 13 | 45 |
| 3 | — | — | 0.5 | 35 | 0.9 | 1 | 5 |
| 4 | — | — | 2 | 15 | 8.0 | 10 | 40 |
| 5 | 0.1 | 100 | 1.5 | 12 | 7.5 | 5 | 30 |
| 6 | 5.0 | 80(Ni—W) | 3.5 | 25 | 1.2 | 2.5 | 22 |
| 7 | 1.0 | 100 | 1.0 | 11 | 1.5 | 6 | 18 |
| 8 | 3.0 | 95(Ni—P) | 0.8 | 9 | 6.0 | 9 | 29 |
| 9 | 1.0 | 100 | — | — | 0 | 0 | 0 |
| 10 | 2.5 | 70(Ni—Fe) | 5.2 | 4 | 18 | 15 | 50 |
| 11 | 0.05 | 100 | 0.05 | 10 | 0.1 | 0.2 | 5 |
| 12 | 6.0 | 100 | 6.0 | 58 | 0.4 | 0.3 | 7 |

Corrosion current, bending workability and contact resistance were measured and evaluated regarding each of the obtained samples.

Corrosion Current

Regarding the corrosion current, disposing a pure aluminum wire coated by resin except an exposed part of 2 mm diameter and a sample coated by resin except an exposed part of 6 mm diameter with facing the exposed parts each other with a distance of 1 mm, the corrosion current was measured between the aluminum wire and the sample in salt water of 5 mass %. A zero shunt ammeter HAI510 made by Hokuto Denko Corporation was used for measuring the corrosion current, so that the corrosion current of the sample after heating at 150° C. for one hour was compared to that before heating. Average current for 1000 minutes was compared.

Bending Workability)

Regarding the bending workability, cutting a sample piece so that a rolling direction is a longitudinal direction, the bending was performed at a pressure of 9.8×103 N perpendicular to the rolling direction using a W bending test device provided in JIS H 3110. Then, they were observed by a stereo microscope. Evaluation of the bending workability was provided as follows. If there was no visible cracks at a bend part after the test, it was evaluated "EXCELLENT". If exposure of copper alloy mother material by a crack was not found even though there was a crack, it was evaluated "GOOD". If the copper alloy mother material was exposed by the crack, it was evaluated "BAD".

Contact Resistance

Conforming JCBA-T323, the contact resistance was measured using a four-probe contact resistance measuring device (made by Yamasaki Seiki Institute, Inc.: CRS-113-AU) by sliding (1 mm) at a pressure 0.98 N. The measurement was performed on a plated surface of a flat plate sample.

Results are shown in Table 2.

TABLE 2

| Sample | Corrosion Current (μA) | | Bending | Contact Resistance |
|---|---|---|---|---|
| No. | Before Heating | After Heating | Workability | (mΩ) |
| 1 | 4.5 | 8.0 | EXCELLENT | 0.7 |
| 2 | 3.5 | 7.0 | EXCELLENT | 0.6 |

TABLE 2-continued

| Sample | Corrosion Current (μA) | | Bending | Contact Resistance |
|---|---|---|---|---|
| No. | Before Heating | After Heating | Workability | (mΩ) |
| 3 | 2.3 | 3.5 | EXCELLENT | 1.0 |
| 4 | 2.1 | 4.5 | EXCELLENT | 1.5 |
| 5 | 2.5 | 2.8 | EXCELLENT | 1.2 |
| 6 | 3.5 | 4.0 | EXCELLENT | 0.8 |
| 7 | 0.9 | 1.4 | EXCELLENT | 0.6 |
| 8 | 1.2 | 2.0 | EXCELLENT | 0.7 |
| 9 | 8.5 | 8.5 | EXCELLENT | 0.5 |
| 10 | 7.5 | 8.0 | BAD | 2.5 |

TABLE 2-continued

| Sample No. | Corrosion Current (μA) Before Heating | After Heating | Bending Workability | Contact Resistance (mΩ) |
|---|---|---|---|---|
| 11 | 6.5 | 8.0 | GOOD | 1.3 |
| 12 | 6.0 | 6.5 | BAD | 2.5 |

Figure 3:
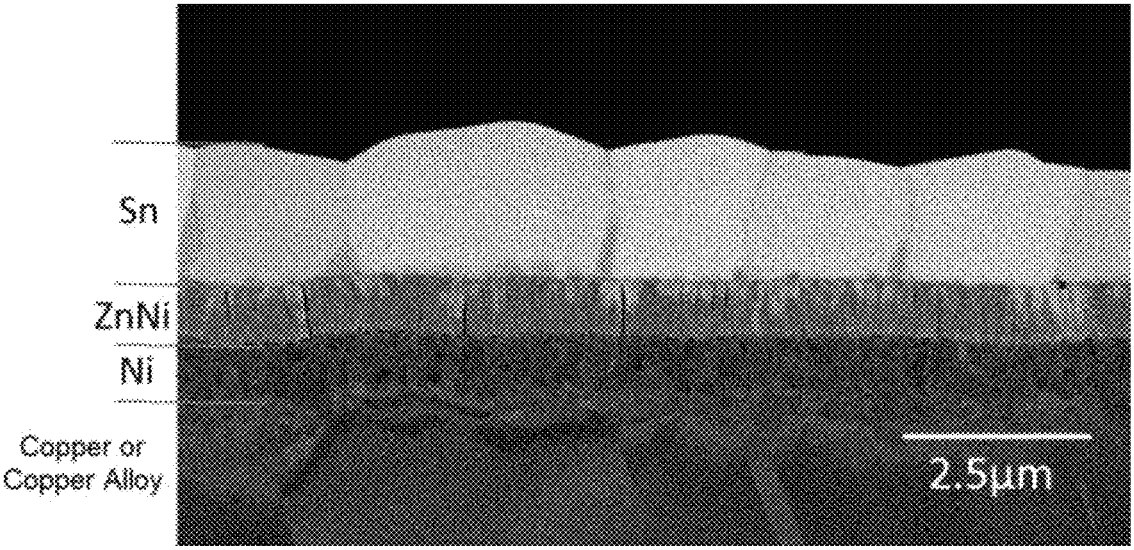
FIG. 3 It is a photomicrograph of a section of a terminal material of Sample 7.

FIG. 3 is an electron micrograph of a section of Sample 7. It is confirmed that the ground layer (a nickel layer), the zinc-nickel alloy layer and the tin layer were formed in order from the base member side. It is not possible to distinguish the outermost surface part of the tin layer.

Figure 4:
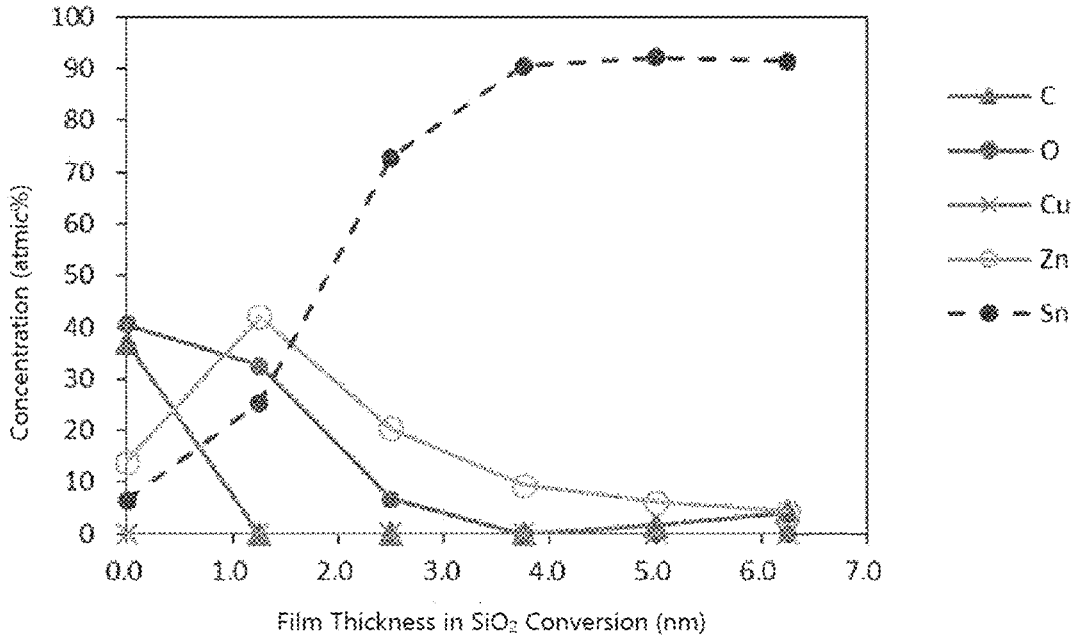
FIG. 4 It is a concentration distribution drawing of elements in a depth direction by an XPS analysis in a surface portion of a terminal material of Sample 6.

FIG. 4 shows a concentration distribution drawing of the respective elements in the depth direction in the surface part by XPS analysis of Sample 6. The metal zinc layer having the zinc concentration of 5 at % to 43 at % is present with a thickness of 5.0 nm in $SiO_2$ conversion, and the zinc concentration is 22 at %. The zinc concentration of the metal zinc layer was an average value of the zinc concentration in the depth direction at a part in which the metal zinc of 5 at % or greater was detected by XPS. The zinc concentration of the metal zinc layer in the present invention is an average value of the zinc concentration in the depth direction at the part in which the metal zinc was detected 5 at % or greater by XPS analysis.

Figure 5:
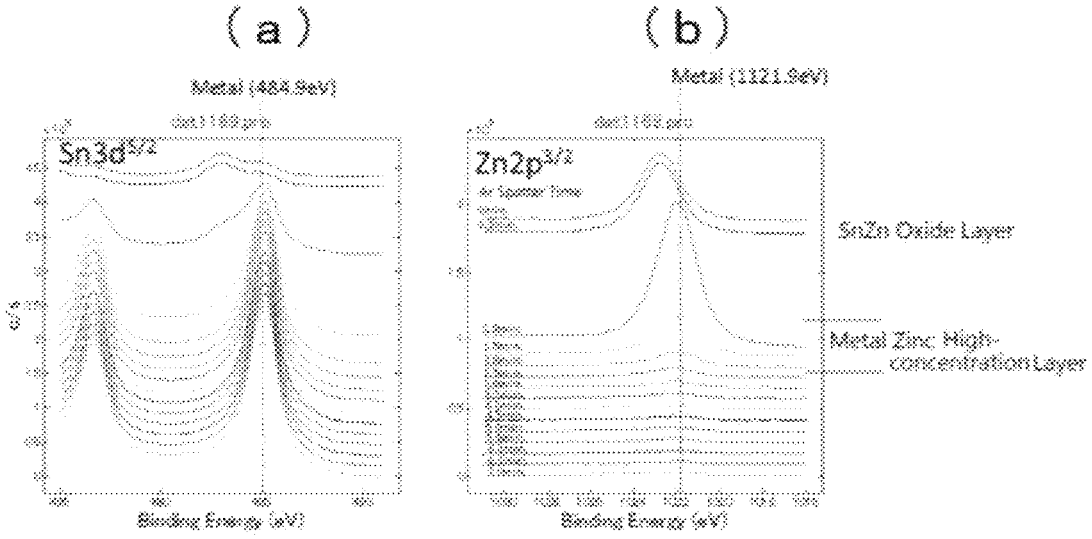
FIG. 5 They are analysis diagrams of chemical states in the depth direction in the surface portion of the terminal material of Sample 6: (a) shows an analysis diagram regarding tin, (b) shows an analysis diagram regarding zinc.

FIG. 5 shows analysis diagrams of chemical states in a depth direction of Sample 7. From a chemical shift of binding energy, it can be judged that oxide is principal in a depth range of 1.25 nm from the outermost surface, and metal zinc is principal in a range deeper than the depth of 2.5 nm.

From the results shown in Table 2, it is found that Samples 1 to 8 have excellent anti-corrosion effect and good bending workability: in Samples 1 to 8, the zinc-nickel alloy layer having the thickness of 0.1 μm to 5.0 μm inclusive and the nickel content of 5 mass % to 50 mass % inclusive is formed, the tin layer has the zinc concentration of 0.6 mass % to 15 mass % inclusive, and the metal zinc layer is formed on the tin layer.

Among these, the corrosion currents of Samples 3 to 8 in which the zinc concentration of the metal zinc layer was 5 at % to 40 at % inclusive and the thickness in $SiO_2$ conversion was 1 nm to 10 nm inclusive were lower than that of Sample 1.

Comparing with Samples 1 to 4 without the ground layers, Samples 5 to 8 in which the ground layers having the thickness of 0.1 μm to 5.0 μm inclusive and the nickel content of 80 mass % or greater were formed between the base members and the zinc-nickel alloy layers have the excellent anti-galvanic corrosion effect even after heating. Among these, Sample 7 and Sample 8 are good in the bend workability and have lower contact resistance than the others, so that especially good results are shown.

The corrosion current was high in Sample 9 of a comparative example since the zinc-nickel alloy layer was not formed. In Sample 10, since the thickness of the zinc-nickel alloy layer was greater than 5.0 μm and the nickel content in the ground layer was low, the corrosion current value was highly deteriorated after heating and the bend workability was bad. In Sample 11, since the thickness of the ground layer was small and the thickness of the zinc-nickel alloy layer was very small, the corrosion current value was high. In Sample 12, since thickness of the ground layer was greater than 5.0 μm and the nickel content of the zinc-nickel alloy layer was greater than 50 mass %, the corrosion current was high and cracks were generated while the bend working.

Figure 6:
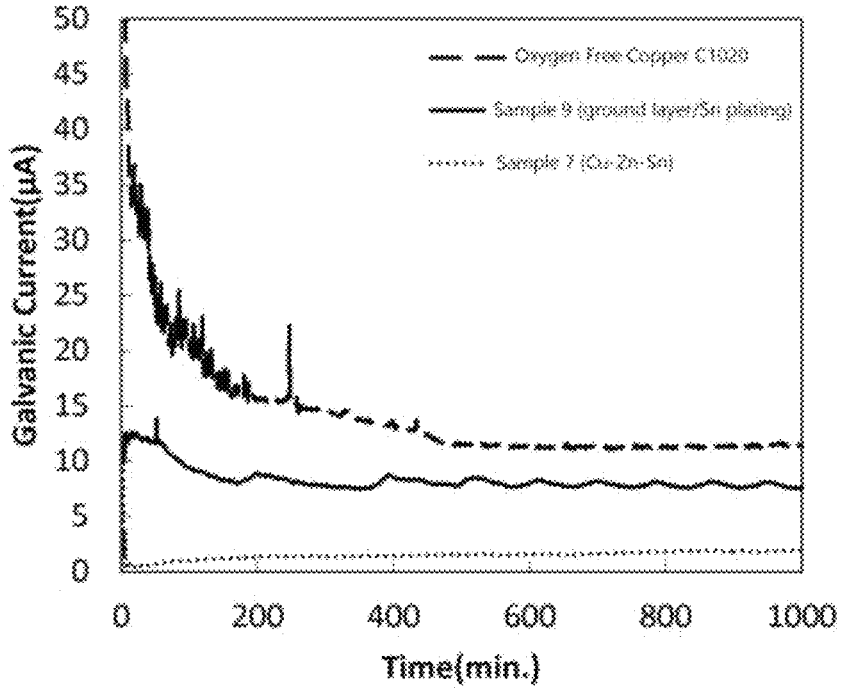
FIG. 6 It is a measured graph of progress of galvanic corrosion regarding each of the terminal material of Sample 6, a terminal material of Sample 9 and copper terminal material without plating.

FIG. 6 shows results of measuring the corrosion current of Sample 7 and Sample 9. For reference, values of terminal material of oxygen free copper (C1020) without plating are also shown. The larger positive value of the corrosion current, the aluminum wire was subjected to galvanic corrosion. It is found that the corrosion current was small in Sample 7 of the example so that the galvanic corrosion could be prevented, as shown in FIG. 6.

INDUSTRIAL APPLICABILITY

Although it is a terminal formed from copper or copper alloy base member, it can be used as a terminal in which the galvanic corrosion do not occur even if it is crimped to the terminal end of the wire made of aluminum wire material.

REFERENCE SIGNS LIST

1 tin-plated copper terminal material
2 base member
3 ground layer
4 zinc-nickel alloy layer
5 tin layer
6 oxide layer
7 metal zinc layer
10 terminal
11 connector part
12 wire
12*a* core wire
12*b* coat part
13 core-wire crimp part
14 coat crimp part

The invention claimed is:

1. Tin-plated copper terminal material comprising a base member made of copper or copper alloy, a zinc-nickel alloy layer consisting of zinc and nickel and a tin layer made of tin alloy stacked on the base member in this order, wherein the zinc-nickel alloy layer has a thickness of 0.1 μm to 5 μm inclusive and a nickel content of 5 mass % to 35 mass % inclusive, the tin layer has a zinc concentration of 0.6 mass % to 15 mass % inclusive, and wherein a metal zinc layer is further provided on the tin layer and under an outermost oxide layer.

2. The tin-plated copper terminal material according to claim 1, the metal zinc layer has zinc concentration of 5 at % to 40 at % inclusive.

3. The tin-plated copper terminal material according to claim 1, further comprising a ground layer made of nickel or nickel alloy between the base member and the zinc-nickel alloy layer that has a thickness of 0.1 μm to 5 μm inclusive and a nickel content of 80 mass % or greater.

4. The tin-plated copper terminal material according to claim 1, wherein the tin-plated copper terminal material is a strip material comprising a plurality of terminal parts connected to a carrier part with spacing along a longitudinal direction of the carrier part.

5. A terminal made of the tin-plated copper terminal material of claim 1.

6. Wire terminal part structure wherein the terminal of claim 5 is crimped to a wire made of aluminum or aluminum alloy.

* * * * *